US005312648A

United States Patent [19]

Gorynin et al.

[11] Patent Number: 5,312,648

[45] Date of Patent: May 17, 1994

[54] METHOD FOR COATING PARTICLES USING COUNTER-ROTATING DISKS

[75] Inventors: Igor V. Gorynin; Boris V. Farmakovsky; Alexander P. Khinsky; Karina V. Kalogina; Evgenii V. Vlasov, all of Leningrad, U.S.S.R.; Alfredo Riviere V., Caracas, Venezuela; Julian Szekely, Weston; Navtej S. Saluja, Cambridge, both of Mass.

[73] Assignee: Technalum Research, Inc., Cambridge, Mass.

[21] Appl. No.: 755,127

[22] Filed: Sep. 5, 1991

[51] Int. Cl.[5] ..... B05D 3/12

[52] U.S. Cl. ..... 427/192; 427/191; 427/216; 427/217; 427/222; 427/242; 75/352; 241/22

[58] Field of Search ..... 427/191, 192, 216, 217, 427/242, 222; 75/351, 352, 354; 428/570; 241/22, 26, 27, DIG. 14

[56] References Cited

U.S. PATENT DOCUMENTS

| | | | |
|---|---|---|---|
| 3,229,923 | 1/1966 | Conley et al. | 241/253 |
| 3,338,688 | 8/1967 | Lange | 29/192 |
| 3,670,970 | 6/1972 | Szegvari | 241/27 |
| 3,817,460 | 6/1974 | Alpha | 241/55 |
| 3,914,507 | 10/1975 | Fustakian | 428/404 |
| 3,954,461 | 5/1976 | Chao et al. | 75/213 |
| 4,129,443 | 12/1978 | Kaufman | 75/212 |
| 4,557,893 | 12/1985 | Jatkar et al. | 419/12 |
| 4,623,388 | 11/1986 | Jatkar et al. | 75/232 |
| 4,627,959 | 12/1986 | Gilman et al. | 75/352 |
| 4,799,955 | 1/1989 | McClellan | 75/352 |
| 4,915,987 | 4/1990 | Nara et al. | 427/242 |

FOREIGN PATENT DOCUMENTS

| | | | |
|---|---|---|---|
| 0406580 | 1/1991 | European Pat. Off. . | |
| 0440093 | 8/1991 | European Pat. Off. . | |
| 62-1084(A) | 1/1987 | Japan . | |
| 62-13504(A) | 1/1987 | Japan . | |
| 1-215903 | 8/1989 | Japan | 75/352 |
| 1560321 | 4/1990 | U.S.S.R. . | |
| 943319 | 12/1963 | United Kingdom . | |
| 1101981 | 2/1968 | United Kingdom . | |
| 1170792 | 11/1969 | United Kingdom . | |
| 1335922 | 10/1973 | United Kingdom . | |
| 2020693A | 11/1979 | United Kingdom . | |
| 2047104A | 2/1980 | United Kingdom . | |
| WO90/02620 | 3/1990 | World Int. Prop. O. . | |

*Primary Examiner*—Terry J. Owens
*Attorney, Agent, or Firm*—Choate, Hall & Stewart

[57] ABSTRACT

A metal-coated particle is prepared by providing a disintegrator apparatus with a working chamber containing counter-rotating disks equipped with teeth design to accelerate particles towards one another, providing a first material and a second metal as powders, such that the first material is harder than the second metal and introducing the first material and second metal powders into the working chamber of the disintegrator apparatus, whereby the soft second metal collides with the hard material and is coated onto the surface of the hard first material. A metal-coated metal with an intermetallic interface is prepared by introducing a first material and a second metal as powders into a disintegrator working chamber containing counter-rotating disks and teeth designed to accelerate particles towards one another. The first material harder than the second metal and is capable of reacting with the second metal to form an intermetallic compound. The disks of the disintegrator are counter-rotted so as to cause the metal powders to collide with each other, whereby the hard metal powder is mechanically coated by second metal. The rate of rotation of the counter-rotating disks are further increased in a high velocity process whereby high local temperatures generated on impact cause a reaction to occur at the first material/second metal interface to form an intermetallic compound.

28 Claims, 3 Drawing Sheets

METHOD FOR COATING PARTICLES USING COUNTER-ROTATING DISKS

BACKGROUND OF THE INVENTION

The present invention relates to coated particles and a method for their preparation. The present invention further relates to thermally reactive powders used in flame spraying processes.

Thermally reactive powders are used to deposit adhesive films, coatings with superior properties (including wear resistant, corrosion resistant and electrical resistant), as well as the manufacture of monolithic products, for example, by the method of self-propagating high temperature synthesis (SHS).

The intense heat generated during the thermally reactive process accelerates the rate of the redox reaction between the components of the composite powder (for example, between aluminum and nickel or iron). Moreover, the reaction can either take place in the whole volume of the powder or spread from one part of the volume to another.

As a result of the reaction, depending on the contents of the gaseous phase, intermetallics, oxides or other compounds are formed. The reaction can take place either in the liquid or the gas phase. Composite powders made by this process have an unusual range of properties and are unique in their strength, ductility and resistance to oxidation over a broad range of temperatures.

The close proximity of the two metal species to one another is important to achieving a smooth continuous reaction. One way of obtaining the close contact of the two materials is to coat one with the other.

U.S. Pat. Nos. 3,338,699 and 3,436,248 disclose metal-coated metals prepared by coating the core metal with a paint composed of an organic binder and powders of the second metal. However, the coating does not adhere well and impurities (decomposition products for the organic binder) are introduced into the powder during the thermal reaction.

Coating a core metal with salt solution of the second metal followed by thermal decomposition of the metal salt has been used to obtain metal-coated metals. Decomposition of the deposited metal salt results in gas evolution and precipitate formation, thus compromising the quality of the metal coating. Degradation of the metal salt layer in the presence of hydrogen leads to cleaner decomposition products, however, impurities still remain.

It is an object of the present invention to provide a method for preparing particles with a variety of coatings. It is a further object of the present invention to prepare thermally reactive powders in the form of metal-coated metals. It is a further object of the invention to prepare such powders free of impurities and additives with optimal adhesion between the metal coating and metal core.

SUMMARY OF THE INVENTION

In one aspect of the present invention, a coated particle is prepared by providing powders of a first material and a second metal, such that the first material has a hardness greater than the second metal and providing an apparatus for accelerating the particle towards each other so that, on collision, the softer metal is coated onto the surface of the harder material.

In another aspect of the present invention, powders of a first hard material and a second soft metal are introduced into a disintegrator apparatus and the disks of the apparatus are counter-rotated so that the particles collide with one another and the soft metal is coated onto the surface of the hard material.

In a preferred embodiment, the first hard material is a non-metallic material, such as metal borides, metal carbides, metal nitrides, metal oxides and organic polymers. In another preferred embodiment, the first hard material is a metal. The metal is a transition metal, alkaline or rare earth metal or their alloys.

Thermally reactive powders can be prepared from any combination of metals provided that they react with one another at elevated temperatures. Thermally reactive materials can be prepared from aluminum and one or more of cobalt, chromium, molybdenum, tantalum, niobium, titanium and nickel; or silicon and one or more of titanium, niobium, chromium, tungsten, cobalt, molybdenum nickel and tantalum. Preferred materials for the preparation of thermally reactive powders are nickel and aluminum as the first and second powders, respectively.

In another preferred embodiment of the present invention, an intermetallic interface is formed between a metal coating and a particle core by selecting as the first hard material a metal capable of reacting to form at least one intermetallic compound with the second soft metal. In the first step, the selected first hard material and second soft metal are introduced into a disintegrator apparatus and the disks of the apparatus are counter-rotated so that the particles collide with one another and the soft metal is coated onto the surface of the hard metal. Then the rate of rotation of the counter-rotating disks is increased, generating high local temperatures at the points of impact. Local high temperatures cause a reaction to occur at the metal/metal interface and an intermetallic compound is formed. The formation of an intermetallic layer at the interface of the two metals ensures that the coating is well-adhered to the core.

Thermally reactive powders can be prepared from any combination of metals provided that they react with one another at elevated temperatures. In a preferred embodiment, the second soft metal is aluminum and the first hard material is a metal chosen to react with aluminum to form at least one intermetallic compound. Materials that react thermally with aluminum include cobalt, chromium, molybdenum tantalum, niobium, titanium and nickel. Nickel is a preferred first hard material.

The composition of the final powder can be controlled by choice of processing atmosphere. In some preferred embodiments of the present invention, it is preferable to process the powders in a protective atmosphere. In other embodiments, a reactive atmosphere is used. Suitable reactive atmospheres include, but are not limited to, oxygen, boron, phosphorous and acetylene group gases.

Practice of the method of the present invention provides a versatile method for obtaining variously-coated particles.

DESCRIPTION OF THE PREFERRED EMBODIMENT

As heretofore indicated, the present invention relates to coated particles and a method for their preparation. More particularly, this invention describes a method for preparing powders using the "Universal Disintegration Activation" technology. The resulting powders are used in the preparation of articles and coatings with a variety of desirable properties, such as strength and corrosion resistance.

Figure 1:
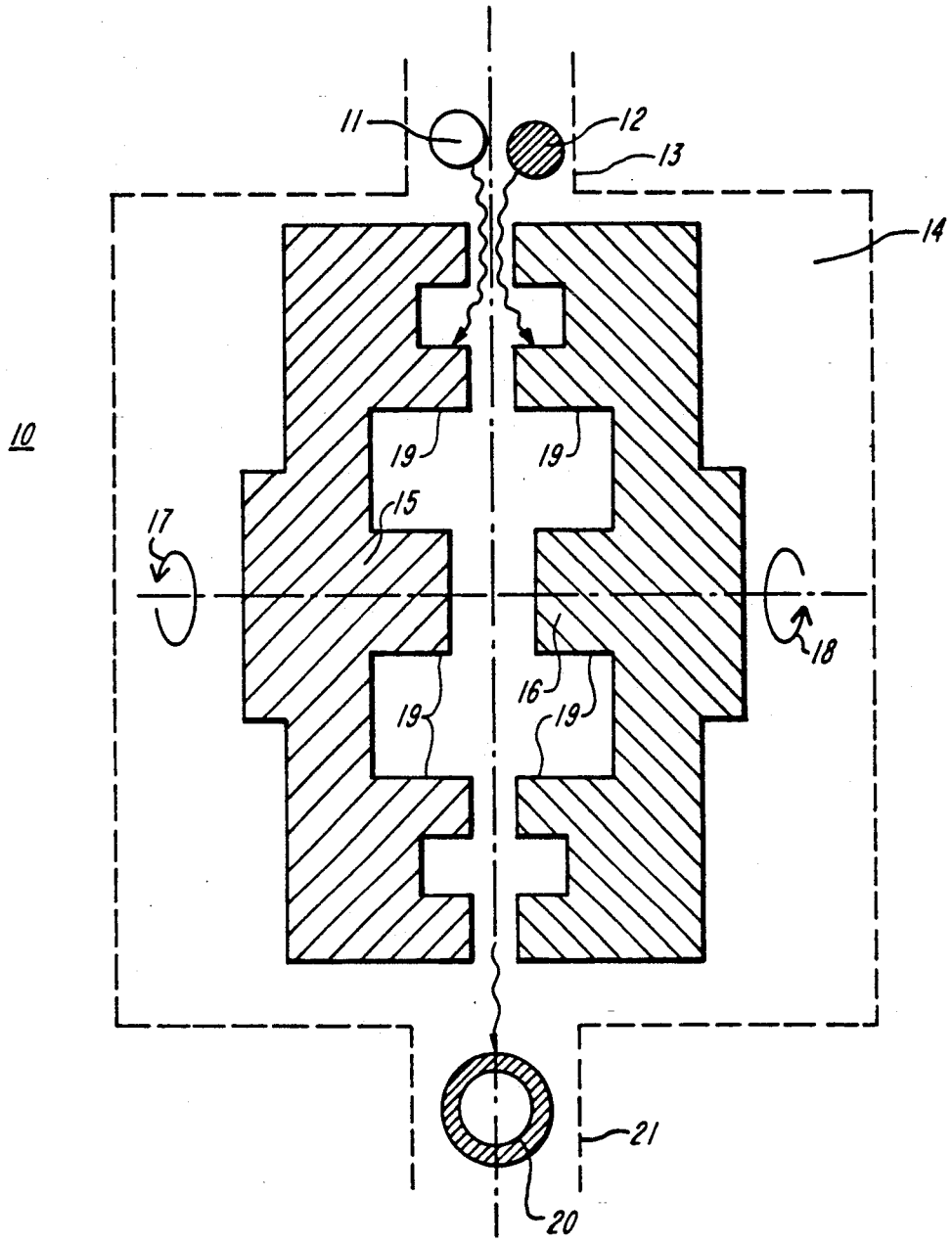
FIG. 1 is a cross-sectional drawing of a disintegrator illustrating the powder-powder coating process of the present invention.

A disintegrator apparatus 10 used in the method of this invention is shown in FIG. 1. A first hard material 11 and a second soft metal powder 12 are introduced from an entry port 13 into a disintegrator chamber 14 defined by two counter-rotating disks 15 and 16. Disks 15 and 16 rotate in directions indicated by arrows 17 and 18, respectively. The cross-section of teeth 19 of the counter-rotating disks 15 and 16 are rectangular, instead of hook-like, which is intended to accelerate the powders 11 and 12 towards one another. Upon contact, the harder first material 11 is coated by the softer second metal 12 to obtain a metal-coated particle 20 which exits the chamber 14 at an exit end 21. It should be apparent from the above description that any apparatus capable of causing metals of different hardness to collide or contact one another is within the scope of this invention.

Materials suitable for the core material are hard ceramics such as refractory metal carbides, borides, nitrides or oxides. Any metal harder than the soft metal used as the coating is appropriate for use as a hard first material. Nickel and titanium are particularly preferred. The particle size of the core material is preferably less then 150 μm and more preferably 40–60 μm.

The second soft metal powder has a particle size preferably less than 40 μm and more preferably 15–20 μm. At particle sizes substantially less than 15 μm, the soft metal powder tends to cluster and is difficult to break up. At particle sizes substantially larger than 20 μm, the soft metal powder becomes too large to easily coat the hard particle. The powders can be premixed prior to introduction into the disintegrator. Because dwell time in the disintegrator chamber is short, premixing is desired to insure adequate contact between the two powders.

The method of the present invention can be used to prepare thermally reactive powders. Thermally reactive powders include those combinations and compositions know in the art. Suitable thermally reactive powders include those of aluminum and one or more of cobalt, chromium, molybdenum, tantalum, niobium, titanium and nickel or silicon and one or more of titanium, niobium, chromium, tungsten, cobalt, molybdenum nickel and tantalum. Alloys of these transition metals can also be used. In a preferred embodiment, the second soft metal is aluminum and the hard metal is nickel.

To obtain mechanically coated powders, that is, powders where there is a sharp interface between the two metals, the metal powders are preferably subjected to at least 600 impacts/second and more preferably 600–900 impacts/second in the disintegrator chamber. The disintegrator disks 15 and 16 rotate at 50–130 m/s.

To obtain chemically bonded powders, that is, powders which have reacted at the aluminum-metal interface to form an intermetallic compound, the powders are subjected to at least $20\times10^3$ impacts/second and preferably $20–40\times10^3$ impacts/second. Theoretical calculations suggest that temperatures of 3000° C. are generated at the moment of contact. The temperature is sufficient to initiate a reaction between the two metals at the interface. If allowed to propagate, the entire particle is consumed and an intermetallic powder is formed. However, the metal disks 16 and 15 of the disintegrator act as a rapid quench and the reaction only occurs at the interface of the two metals.

The thickness of the metal coating is determined by the relative proportion of soft metal and hard material used and by the size of the particle being coated. The particle size of the first powder used as the core material limits the overall coated particle size. However, some crushing of the particles during processing is unavoidable.

Figure 2:
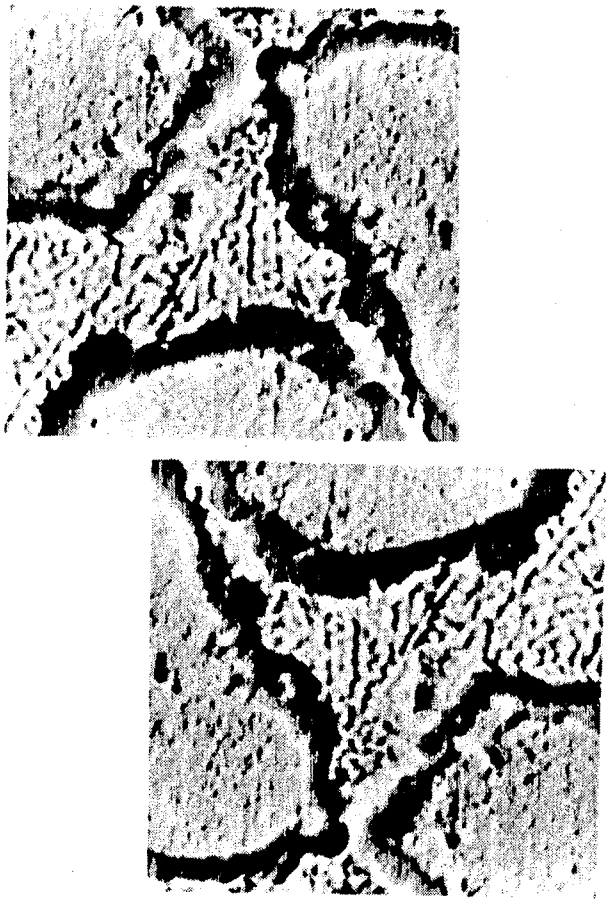
FIG. 2 is a photomicrograph which shows a cross-section of the aluminum-coated nickel particles (4000×magnification)
Figure 3:
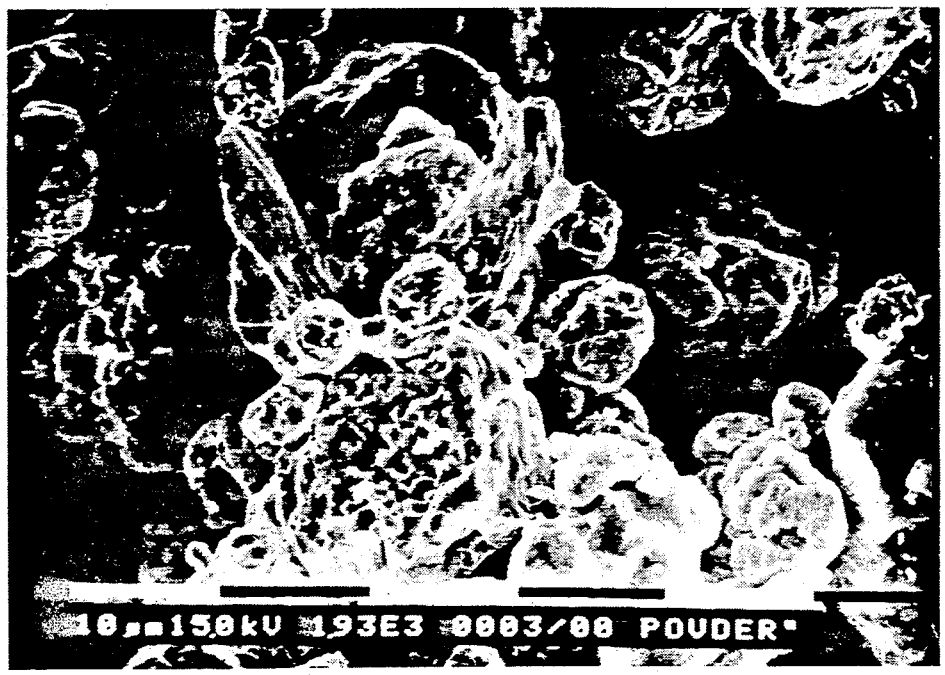
FIG. 3 is a photomicrograph of Al-coated nickel particles prepared according to the method of the invention.

FIG. 2 is a photomicrograph of aluminum-coated particles in a cross-sectional view magnified 4000×. The dark band is the aluminum coating and the lighter interior is the nickel metal. The particles are distorted from an ideal spherical shape because of impacts during the coating process. FIG. 3 is a photomicrograph of Al-coated particles showing the particle size and irregular shape resulting from the coating process.

The composition of the final powder can be controlled by choice of processing atmosphere. In some preferred embodiments of the present invention, it is preferable to process the powders in a protective atmosphere. Suitable atmospheres include argon and nitrogen. Oxygen levels are preferably less than 0.001%. Under these processing conditions, the aluminum does not react and an aluminum metal coating is formed.

In other embodiments, a reactive atmosphere is used. Suitable reactive atmospheres include, but are not limited to, oxygen, boron, phosphorous and acetylene group gases resulting in the formation of coatings of oxides, borides, phosphides and carbides, respectively. Because the thickness of the coated layer is thin, the layer has plastic properties and does not flake off.

EXAMPLE 1

In the first step of the process, nickel powder (43–70 μm) and aluminum powder (3–20 μm) in a ratio of 4 to 1, respectively, were processed in a disintegrator apparatus in a rigorously inert atmosphere according to the method of the invention. The disintegrator disks were counter-rotated at 60–90 m/s and the powders were subjected to 500–550 impacts/second. An aluminum-covered nickel powder was recovered and characterized. Particle size distribution of the particles is reported in Table 1 and shows that 94% of the particles are ≦53 μm. The composition of the particles was determined by X-ray analysis. The data shown in Table 2 establish the existence of free nickel and aluminum and some intermetallic compound. The smaller particles contain a greater amount of intermetallic compound. The impact forces needed to generate the smaller particles were greater and therefore were able to generate the heat necessary to form intermetallic compounds.

TABLE 1

| Particle Size Distribution | |
|---|---|
| particle size (μm) | distribution (%) |
| 100 | 0.8 |
| 70 | 3.6 |
| 53 | 27.4 |
| 43 | 64.3 |
| <43 | residual |

TABLE 2

| Phase Composition of Ni—Al Powder after Mechanical Coating* | | | | | |
|---|---|---|---|---|---|
| particle size | Al | Ni | $Ni_3Al$ | $NiAl_3$ | Ni—Al alloy |
| 100 | 196 | 93 | — | — | 9 |
| 70 | 132 | 86 | 6 | — | 15 |
| 53 | 78 | 102 | 12 | 9 | 32 |
| 43 | 69 | 114 | 14 | 12 | 36 |
| <43 | 72 | 116 | 15 | 14 | 38 |

*in relative units

EXAMPLE 2

The identical nickel and aluminum powders of Example 1 were subjected to a two stage processing step. The nickel was mechanically coated with aluminum according to the method of Example 1. The powders were then further subjected to a high velocity process in an inert atmosphere in which the disintegrator disks rotated at 20,000–21,000 rpm and the powders experienced $12–18\times10^3$ impacts/sec. An aluminum-covered nickel powder was recovered and characterized. Particle size distribution of the particles is reported in Table 3 and shows that 98.8% of the particles were less than 53 μm in size. The composition of the particles was determined by X-ray analysis and is reported in Table 4. Considerably higher levels of intermetallic compound was observed and the aluminum coating was much thinner, presumably because more of the aluminum was consumed in the formation of $Ni_3Al$ and $NiAl_3$. The mean particle had decreased because of the increased number of impacts experienced by each particle.

TABLE 3

| Particle Size Distribution | |
|---|---|
| particle size (μm) | distribution (%) |
| 100 | 0.0 |
| 70 | 31.2 |
| 53 | 12.4 |
| 43 | 74.7 |
| <43 | residual |

TABLE 4

| Phase Composition of Ni—Al Powder after Mechanical Coating* | | | | | |
|---|---|---|---|---|---|
| particle size | Al | Ni | $Ni_3Al$ | $NiAl_3$ | Ni—Al alloy |
| 100 | 74 | 116 | 35 | 16 | 12 |
| 70 | 68 | 125 | 32 | 18 | 19 |
| 53 | 60 | 139 | 38 | 20 | 26 |
| 43 | 58 | 185 | 25 | 20 | 32 |
| <43 | 55 | 196 | 22 | 32 | 44 |

*in relative units

EXAMPLE 3

A metal oxide powder such as ZnO (40–100 μm) and aluminum powder (3–20 μm) are processed in a disintegrator apparatus in an inert atmosphere according to the method of the invention. The disintegrator disks are counter-rotated at 60–90 m/s and the powders are subjected to 500–550 impacts/second. An aluminum-covered ZnO powder is recovered.

EXAMPLE 4

A nickel powder (53–70 μm) and an aluminum powder (3–20 μm) are processed in a disintegration in air according to the method of the invention. The disintegrator disks are counter-rotated at 60–90 m/s and the powders are subjected to 500–550 impacts/second. The aluminum is oxidized in the reactive atmosphere during the process and an alumina-coated nickel powder is recovered.

What is claimed is:

1. A method of preparing a coated particle comprising the steps of:

providing a working chamber containing counter-rotating disks equipped with teeth capable of accelerating particles towards one another;

providing a first material and a second metal as powders, said first material having a hardness greater than said second metal; and introducing said first material and said second metal powders into said working chamber, whereby said second metal collides with said first material and said second metal is coated onto the surface of said first material.

2. The method of claim 1 wherein said counter rotating disks have a velocity of 50–130 m/s .

3. The method of claim 1 wherein said first and second powders are subjected to a range of 500 to 900 impacts/sec.

4. The method of preparing a coated particle comprising the steps of:

providing a working chamber containing counter-rotating disks equipped with teeth capable of accelerating particles towards one another;

introducing a first material and a second metal as powders, said first material having a hardness greater than said second metal and said first material capable of reacting with said second metal;

counter-rotating said disks of said working chamber in a low velocity process so as to cause said first material and second metal powders to collide with each other, whereby said first material powder is mechanically coated with said second metal; and further increasing the rate of rotation of said counter-rotating disks in a high velocity process, whereby said second metal coating is chemically bonded to said first material.

5. The method of claim 1 or 4 wherein said first material is a metal.

6. The method of claim 5 wherein said first material is selected from the group consisting of transition metals, rare earth and alkaline earth metals and their alloys.

7. The method of claim 1 or 4 wherein said first material is a non-metallic material.

8. The method of claim 7 wherein said non-metallic material is selected from the group consisting of metal borides, carbides, nitrides, and oxides and organic polymers.

9. The method of claim 1 or 4 wherein said coated particle comprises aluminum and one or more of the metals of the group consisting of cobalt, chromium, molybdenum, tantalum, niobium, titanium and nickel.

10. The method of claim 1 or 4 wherein said coated particle comprises silicon and one or more of the metals of the group consisting of cobalt, chromium, molybdenum, tantalum, niobium, titanium, tungsten and nickel.

11. The method of claim 1 or 4 wherein said second metal comprises aluminum and said first material comprises nickel.

12. The method of claim 1 or 4 wherein means of rapid heat removal is provided by the working chamber.

13. The method of claim 1 or 4 wherein the second soft metal powder has a particle size less than 40 μm.

14. The method of claim 1 or 4 wherein the second soft metal powder has a particle size in the range of 15 to 20 μm.

15. The method of claim 1 or 4 wherein said first hard material has a particle size less than 150 μm.

16. The method of claim 1 or 4 wherein said first hard material has a particle size in the range of 40 to 60 μm.

17. The method of claim 1 or 4 wherein the process is carried out under a protective atmosphere.

18. The method of claim 17 wherein said protective atmosphere is argon or nitrogen.

19. The method of claim 17 wherein said protective atmosphere contains less than 0.001% oxygen.

20. The method of claim 1 or 4 wherein the process is carried out in a reactive atmosphere.

21. The method of claim 20 wherein said reactive atmosphere is selected from the group consisting of oxygen, ammonia, phosphorous and acetylene group gases.

22. The method of claim 4 wherein said counter-rotating disks have a velocity of 250–450 m/s during said high velocity process.

23. The method of claim 4 wherein said second metal and first material powders are subjected to not less than $20\times10^3$ impacts/second during said high velocity process.

24. The method of claim 4 wherein said second metal and first material powders are subjected to $20–40\times10^3$ impacts/second during said high velocity process.

25. The method of 1 or 4 wherein said first material and said second metal are premixed prior to introduction into said working chamber.

26. The method of 1 or 4 wherein the process is carried out in a vacuum.

27. The method of claim 4 wherein said counter rotating disks have a velocity of 50–130 m/s during said low velocity process.

28. The method of claim 4 wherein said first and second powders are subjected to a range of 500 to 900 impacts/sec during said low velocity process.

* * * * *